US008770449B2

(12) United States Patent
Wellman

(10) Patent No.: US 8,770,449 B2
(45) Date of Patent: Jul. 8, 2014

(54) DISPENSER

(75) Inventor: Craig Wellman, Ingleburn (AU)

(73) Assignee: Sophinity Pty Ltd, Ingleburn, New South Wales (AU)

( * ) Notice: Subject to any disclaimer, the term of this patent is extended or adjusted under 35 U.S.C. 154(b) by 1047 days.

(21) Appl. No.: 12/528,990

(22) PCT Filed: Feb. 28, 2008

(86) PCT No.: PCT/AU2008/000261

§ 371 (c)(1),
(2), (4) Date: Mar. 5, 2010

(87) PCT Pub. No.: WO2008/104029

PCT Pub. Date: Sep. 4, 2008

(65) Prior Publication Data

US 2010/0163584 A1 Jul. 1, 2010

(30) Foreign Application Priority Data

Feb. 28, 2007 (AU) ..... 2007901046

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 37/00*** | (2006.01) |

(52) U.S. Cl.
USPC ..... 222/494; 222/490; 222/213; 222/567

(58) Field of Classification Search
USPC ..... 222/490, 491, 494, 212, 213, 566–575
See application file for complete search history.

(56) References Cited

U.S. PATENT DOCUMENTS

| | | | | | |
|---|---|---|---|---|---|
| 492,767 | A * | 2/1893 | Acheson | 423/345 |
| 2,107,106 | A * | 2/1938 | Crook | 222/494 |
| 3,610,477 | A * | 10/1971 | Herzig | 222/494 |
| 4,109,836 | A * | 8/1978 | Falarde | 222/494 |
| 4,148,420 | A * | 4/1979 | Morrissette et al. | 222/494 |
| 4,492,253 | A * | 1/1985 | Raftis | 137/849 |
| 5,456,294 | A * | 10/1995 | Tsao et al. | 222/494 |
| 6,199,725 | B1 * | 3/2001 | Garibaldi | 222/207 |
| 6,968,976 | B2 * | 11/2005 | Masuda | 222/92 |
| 7,086,572 | B2 * | 8/2006 | Socier et al. | 222/494 |
| 7,306,127 | B2 * | 12/2007 | Eimer | 222/494 |
| 2004/0050872 | A1 * | 3/2004 | Masuda | 222/494 |
| 2007/0295764 | A1 * | 12/2007 | Socier | 222/494 |

FOREIGN PATENT DOCUMENTS

| | | | | |
|---|---|---|---|---|
| JP | 11-059750 | A | 3/1999 | |
| JP | 2000-142737 | A | 5/2000 | |
| JP | 2004-142805 | A | 5/2004 | |
| WO | WO 2006105574 | A1 * | 10/2006 | F16K 15/16 |
| WO | WO 2008015505 | A1 * | 2/2008 | B65D 47/20 |

* cited by examiner

*Primary Examiner* — Paul R. Durand
*Assistant Examiner* — Matthew Lembo
(74) *Attorney, Agent, or Firm* — Kilpatrick Townsend & Stockton LLP

(57) ABSTRACT

A dispenser (10) for dispensing a fluid from a container T comprises an inlet (14) for connecting to the container so as to receive the fluid therethrough, and an outlet (16). The outlet comprises at least two walls (18), each with a respective slit (22) thereon adapted to open to release fluid therefrom when a predetermined pressure is applied to the fluid in the dispenser at the outlet, and to close to retain fluid in the dispenser at a pressure less than the predetermined pressure.

18 Claims, 5 Drawing Sheets

DISPENSER

CROSS REFERENCE TO RELATED APPLICATIONS

This application is a National Stage of International Application No. PCT/AU2008/000261 filed Feb. 28, 2008 and which claims the benefit of Australian Patent Application No. 2007901046, the disclosures of all applications being incorporated herein by reference.

TECHNICAL FIELD

A dispenser for dispensing a fluid from a container is disclosed. The dispenser comprises a self-closing valve and optionally a tamper evident hermetic seal. The dispenser is particularly though not exclusively adapted for dispensing viscous fluids from pliable containers such as tubes and bottles.

BACKGROUND ART

Viscous fluids such as cosmetic creams and pastes (including toothpaste), medicament creams and pastes, soaps and detergents, food pastes and sauces, adhesives and glues, fillers and binding agents etc are often stored in and dispensed from pliable containers, especially tubes, bottles, tubs etc. Such a container may comprise a dispenser component having one end mounted to an open end of the container. The dispenser may have a spout at an opposing end from which the fluid is released. The fluid can be caused to be released by pressuring the tube interior (e.g. by manually squeezing a pliable wall thereof) which applies pressure to the fluid and forces it into the dispenser component, to ultimately issue forth out of the spout.

The spout of the dispenser component can be closed by a screw cap, a flip-top lid or other similar closure device. The use of such closure devices may result in a build-up of fluid around the sealing area making them difficult to close. If not properly closed by a user, then fluid in the dispenser component can degrade due to oxygen ingress or be inadvertently released from the spout, leading to mess and/or cap or lid seizure or fastening. Also, if the fluid itself is hazardous, improper closing can sometimes present a hazard.

U.S. Pat. No. 1,977,227 discloses a self closing paste tube. The head of the tube comprises four metal sections coated by rubber to define an outlet that automatically closes upon removal of a squeezing pressure upon the tube.

U.S. Pat. No. 2,792,149 discloses a collapsible tube for toothpaste. A dispensing head is attached to the tube that opens when pressure is applied to the tube and closes after that pressure is released. The head is formed from a single piece of plastic material.

U.S. Pat. No. 4,139,124 discloses a liquid dispensing container. The container includes a self closing conduit, which is urged closed by a plurality of elongate beads surrounding the conduit.

A reference herein to a prior art document is not an admission that the document forms part of the common general knowledge of a person of ordinary skill in the art in Australia or elsewhere.

SUMMARY OF THE DISCLOSURE

According to a first aspect there is provided a dispenser for dispensing a fluid from a container, the dispenser comprising:

an inlet for connecting to the container so as to receive the fluid therethrough; and an outlet comprising, at least two walls each with a respective slit thereon adapted to open to release fluid therefrom when a predetermined pressure is applied to the fluid in the dispenser at the outlet, and to close to retain fluid in the dispenser at a pressure less than the predetermined pressure.

According to a second aspect there is provided a dispenser for dispensing a fluid from a container, the dispenser comprising:

an inlet for connecting to the container so as to receive the fluid therethrough; and an outlet comprising at least two upstanding intersecting walls each with a respective slit on a distal end thereof adapted to open to release fluid therefrom when a predetermined pressure is applied to the fluid in the dispenser at the outlet, and to close to retain fluid in the dispenser at a pressure less than the predetermined pressure.

The shape and arrangement of the walls and slits may be such that, when the fluid in a container to which the dispenser is attached is extruded from the slits, the extruded fluid has a cross-sectional shape approximating a three-pointed star with concave sides between the points of the star. This cross-sectional shape, which may also be considered as approximating a circle, is particularly desirable when the fluid being extruded is toothpaste.

For example, problems have been encountered with prior art self-closing duck-bill valve components, such as the valve described in the applicant's co-pending International Patent Application No. WO-A-2006/105574, whereby the longitudinal shape of toothpaste extruded therefrom is ribbon-like. Such a ribbon-like shape may not be desirable as a toothpaste extrusion, because the maximum volume of toothpaste provided in a single pass of the associated toothpaste tube on the bristles of a standard toothbrush is likely to be below a minimum required toothpaste volume, for example, if the lateral and longitudinal width of the extrusion approximates that of the set of toothbrush bristles. The dispenser of the present disclosure can however, be configured such that the volume of a single pass toothpaste extrusion therefrom exceeds the above mentioned minimum desired volume (eg. the extrusion has a transverse width and a length approximating that of a standard set of toothbrush bristles).

The term "fluid" is intended to include liquids, viscous liquids and flowable solids; pastes and creams etc.

The term "container" is intended to include tubes, bottles, jars, tubs, cylinders, vessels, flasks, chambers etc, whether pliable or rigid. Thus, in the case of a pliable container, pressure may be manually applied to an external pliable wall of the container. In the case of a rigid container, pressure may be applied to fluid within the container by e.g. a plunger, piston, pump etc.

In one application the dispenser is suitable for and employed with a container that has a single outlet, with the dispenser being mountable at that outlet such that any fluid leaving the container via the single outlet is directed into the inlet of the dispenser.

In one form the container and dispenser can be adapted for mounting to each other (e.g. the dispenser can be purpose-built for the container, or vice versa, or both). For example, compatible materials can be employed that enable easy mounting (such as by heat welding, adhesive etc). Such materials may also have resistance to the substance stored in the container.

Optionally, the slits can be co-joined at a respective proximal end thereof. This can ensure that a single extrusion of fluid exits the dispenser in use.

Optionally, a respective lateral face of each of two adjacent said walls can be on intersecting planes and the slits can each be located on an end of their respective wall.

Optionally, the dispenser can comprise at least one support in each wall. Each support may be positioned at a distal (outside or lateral) end of its respective wall. The supports may be support posts. The posts may be resilient and the walls may be flexible. The use of posts can help in providing resistance to movement of the flexible walls, the resistance of which can be overcome by forcing of fluid through the outlet. Optionally, the walls can be of an elastomeric material.

Optionally, the dispenser can comprise a support region extending between and integral with each of two adjacent walls, the support region being positioned away from the slits. The support region may extend out from the plane of the respective face of each wall. Optionally, the support region can be rounded.

The inlet may be round or rounded.

Optionally, the dispenser can comprise a removable seal over the slits. The seal may be frangibly connected to distal ends of the support posts. The removal of the seal can then enable the outlet to open in use. This can provide a tamper evident function to the dispenser (i.e. prior to consumption of the fluid in the container). Further, the seal may be arranged to provide a gas tight and hermetic seal after the dispenser is mounted to a container. For example, in the case of a tube, this seal can result after mounting of the dispenser to one tube end and after closing of the opposite tube end (ie. after fluid filling of the tube), thus proving an integrated unit with a complete hermetic seal.

Optionally, the dispenser can comprise three said walls, each having one said slit thereon, and wherein each of the slits are co-joined at a proximal end thereof. The slits may be equiangular to each other.

Optionally, the dispenser can comprise three said supports, wherein each of the supports is associated with a respective one of the walls.

Optionally, the walls can be parallel to a central dispenser axis that extends from the outlet to the inlet, said slits extending radially from the axis.

According to another aspect there is provided a dispenser for dispensing a fluid from a container, the dispenser comprising:

a first resilient part having an inlet so as to receive the fluid therethrough; and a second elastomeric part having an outlet adapted to open to release fluid therefrom when a predetermined pressure is applied to the fluid in the dispenser at the outlet and to close to retain fluid in the dispenser at a pressure less than the predetermined pressure, wherein the second part comprises two or more walls each with a respective slit thereon to provide the opening and the first part comprises one or more supports for supporting at least one of the walls, the one or more supports being within at least one of the two or more walls.

Optionally, the walls can be planar and at least one of the walls can lie on a plane intersecting the plane of at least one other wall. Optionally, the slits can be co-joined at a respective proximal end thereof.

Optionally, the walls can be formed from a material which is incompatible with the material from which the supports are formed. This means different materials can be used for the walls and the supports, where the materials have different properties suitable for the purpose of use in the wall or the supports. In using incompatible materials, the invention is not constrained in choice of materials to be used. The term "incompatible" is used herein in a materials sense, where incompatible materials do not chemically bond to one another.

According to another aspect there is provided a dispenser for dispensing a fluid from a container, the dispenser comprising:

a first resilient part formed from a first material and having an inlet so as to receive the fluid therethrough; and a second elastomeric part formed from a second material and having an outlet adapted to open to release fluid therefrom when a predetermined pressure is applied to the fluid in the dispenser at the outlet and to close to retain fluid in the dispenser at a pressure less than the predetermined pressure, wherein the first material and the second material are incompatible.

Optionally, the second part can comprise two or more walls each with a respective slit thereon to provide the opening, and the first part can comprise one or more supports for supporting at least one of the walls, the one or more supports being within at least one of the two or more walls. Optionally, the walls can be planar and at least one of the walls can lie on a plane intersecting the plane of at least one other wall.

Both the elastomeric and resilient materials may comprise polymers, either with thermoplastic or thermoset properties. Elastomeric and resilient materials may each be selected that resist degradation from aromatic and other solvents present in the container fluid, and may comprise materials that also provide a barrier to gas or moisture migration into/from the container.

The elastomeric material can be silicon. Alternatively, the elastomeric material can be a thermoplastic or thermoset elastomer-rubber or another relatively flexible/deformable elastomer, for example, thermoplastic polyurethane (TPU). The resilient material can be a thermoplastic or thermoset polymer selected to provide strength and resiliency, for example, a nylon (polyamide), a polyethylene such as high density polyethylene (HDPE), a polypropylene, a polyethylene terephthalate, a polybutylene terephthalate or another resilient (e.g. relatively stiff or rigid) polymer.

The dispenser can be formed by co-moulding or bi-moulding the resilient material with the elastomeric material, both methods providing for cost efficient, rapid, reproducible and efficacious dispenser manufacture.

The container can also be formed of the same or a compatible material to the resilient material of the dispenser to better enable their mounting together (e.g. by bonding, adhesion, welding etc).

The dispenser can converge downwardly from the inlet to outlet. This directs and favours fluid delivery to the outlet (e.g. when the container is pressurised).

The dispenser can be adapted for mounting to an open end of a container in the form of a pliable or rigid tube or bottle. However, the dispenser may also be used with rigid piston, plunger or pump-actuated tubes and cylinders etc. In one application, the inlet of the dispenser is circular for affixing to an open circular end of a tube or bottle, with the opposite end of the tube or bottle being closed. The tube or bottle may also be generally circular in cross-section along its length or be closed by a sealed straight edge at its opposite end. Alternatively, the tube may have a generally square or other cross-sectional shape, with the dispenser inlet being shaped accordingly.

The dispenser inlet can be welded to the open end of the tube or bottle. Alternatively the dispenser inlet can be adhesively or screw-mounted to the tube or bottle, or it can be push, interference or snap-fitted to an open end of the tube or bottle. In some of these cases the dispenser may be removably mounted to the tube or bottle.

In one mode of use, the dispenser receives fluid out of a tube or bottle open end when the tube or bottle is squeezed, pressed or pressured internally. The predetermined pressure applied to the fluid in the dispenser can be reached as a result of the tube or bottle being squeezed, pressed or pressured. The predetermined pressure is then released when the squeezing, pressing or pressuring of the tube or bottle is eased or ceases.

In this regard, the predetermined pressure can correspond with a manually applied squeezing, pressing or pressuring of the container by a user. For example, where the fluid is a viscous fluid such as toothpaste, the predetermined pressure can correspond with that pressure applied by a user when squeezing a tube (or bottle) between his/her fingers.

In this mode of use, the dispenser can be adapted for use and operation with viscous fluids such as toothpastes, creams, food pastes/sauces, detergents, resins, adhesives etc.

According to another aspect, there is provided a component of a dispenser for dispensing a fluid from a container, the component comprising:

an inlet for connecting to the container so as to receive the fluid therethrough;

a plurality of supports extending from a portion of the component defining the inlet, the supports being configured to support a second component having an outlet comprising at least two walls each with a respective slit thereon adapted to open to release fluid therefrom when a predetermined pressure is applied to the fluid in the dispenser at the outlet, and to close to retain fluid in the dispenser at a pressure less than the predetermined pressure; and a detachable seal connected to at least one of the supports for sealing the outlet.

According to yet another aspect, there is provided a component of a dispenser for dispensing a fluid from a container, the component comprising:

an inlet for connecting to the container so as to receive the fluid therethrough;

one or more post members extending from a portion of the component defining the inlet, the post member(s) being configured to support a second component having an outlet that is adapted to open to release fluid therefrom when a predetermined pressure is applied to the fluid in the dispenser, and to close to retain fluid in the dispenser at a pressure less than the predetermined pressure.

Optionally, the post member(s) may be configured to extend within a second component formed thereover.

BRIEF DESCRIPTION OF THE DRAWINGS

Specific embodiments of the dispenser will now be described, by way of example only, with reference to the accompanying drawings in which.

DETAILED DESCRIPTION OF SPECIFIC EMBODIMENTS

Figure 1:
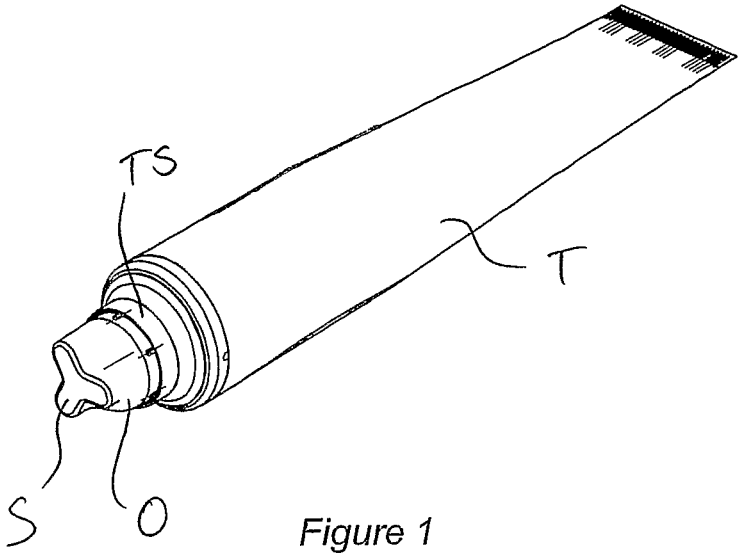
FIGS. 1 and 2 illustrate perspective and side views of a container having a dispenser in accordance with a specific embodiment.
Figure 2:
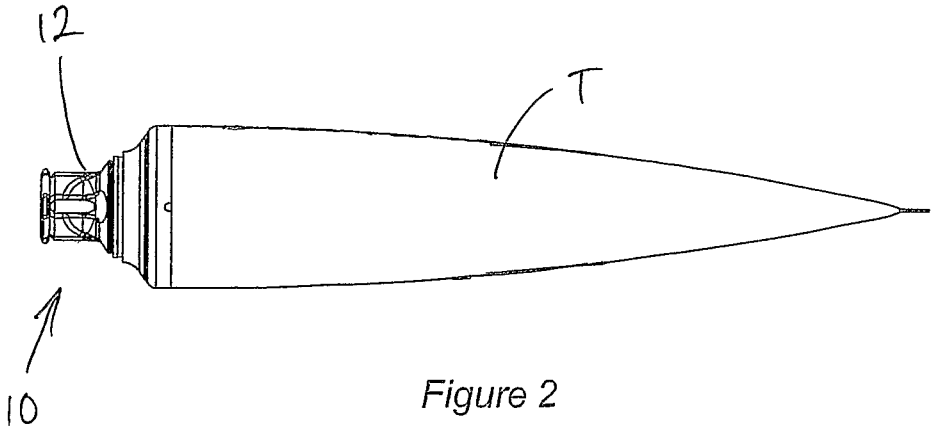

Referring firstly to FIG. 1, a pliable/flexible tube T is shown with an overcap O mounted thereto. The overcap O covers and protects a dispenser in the form of a self closing valve component 10 mounted to the end of tube T, as illustrated in FIG. 2. The valve component 10 can be mounted to a variety of container types and shapes, but is shown in FIG. 1 as being mounted to a tube T, such as a polypropylene squeezable tube. It will be appreciated that the tube T is just one example of a container to which the component 10 can be mounted. In this regard, the tube T of the drawings may readily be substituted with a pliable/flexible bottle etc.

The tube need not have a circular cross-section, and may e.g. be generally square, triangular etc in cross-section (e.g. to provide flat surfaces for easier printing or labelling thereon). However, when circular in cross-section, the tube T has a circular open end for mounting to the body 12, and is closed at its opposite end.

The tube typically houses a viscous fluid such as a cosmetic cream or paste (e.g. toothpaste), a shampoo or conditioner, a medicament cream or paste, a soap or detergent, a food paste or sauce, an adhesive or glue, a filler or binding agent etc.

The overcap O is typically used during storage, transport and in-store, but may be re-used during use of the tube or discarded after initial removal. The overcap can provide tamper resistance and provide for tamper evidence. It may also provide a secondary sealing function (described below). The shape and configuration of a distal surface S of the overcap O also allows the tube T and valve component 10 to remain in a stable upright, or standing, position when the distal surface S is placed on a horizontal surface, for example, a supermarket shelf.

The self closing valve component 10 enables the tube T to be repeatedly used without the need for a separate closing action (such as from a screw cap or flip-top lid etc).

Referring to FIGS. 3 to 9, the self closing valve component 10 has an inlet 14 on the body 12 so as to receive therethrough a fluid from the tube T and an outlet 16 through which the fluid from the tube T can be extruded. The outlet comprises three walls 18 which in this embodiment are equiangular about a central axis of the valve component 10, lying on intersecting planes. Distal ends 20 of the walls taper or are bevelled to a ridge line at which are located slits 22, where each wall 18 has one slit 22 on its distal end 20. The slits 22 are arranged such that they are co-joined at respective proximal ends 23, in this embodiment being at the central axis of the valve component 10. This, in effect, provides a single combined slit in two dimensions. In this embodiment, the slits 22, together with the distal wall ends 20 reside on a common plane, however, in alternative embodiments the distal ends 20 of the walls 18 may collectively taper toward or away from the inlet 14, or be curved toward or away from the inlet 14.

Figure 5:
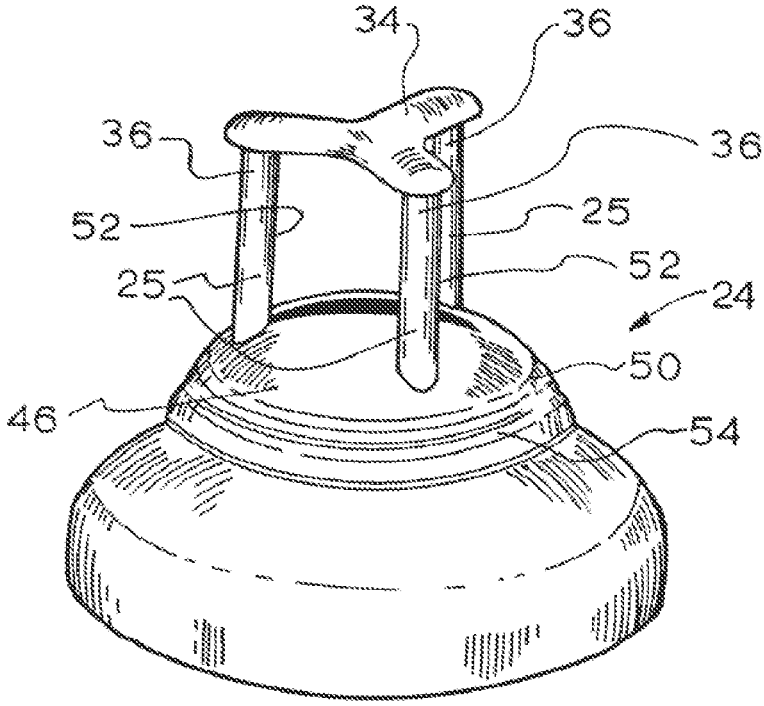
FIG. 5 illustrates a component of the dispenser illustrated in FIGS. 1 to 4.

As will be discussed in more detail below, the component 10 is formed from two bodies, a first body 24 of which is illustrated in FIG. 5. As illustrated in FIG. 5, the first body 24 comprises supports in the form of three support posts 25, each support post 25 being associated with and covered by a respective one of the walls 18. The support posts 25 are resilient and provide support and resistance to movement of the relatively flexible elastomeric walls 18 such that the walls can pressurise to a predetermined threshold pressure prior to opening of the slits 22. Hence, the valve component 10 can remain closed unless the predetermined threshold pressure is exceeded. The support posts 25 are positioned at respective lateral ends 26 of the walls 18 so as not to interfere with the opening of the slits 22 to allow fluid therethrough. The support posts 25 are described in more detail below.

Additional support regions in the form of three bellows 28, each bellow between positioned between a respective pair of adjacent walls 18, and are formed integrally with the walls 18 in a one piece construction. The bellows 28 aid in biasing the slits 22 into their closed condition when no pressure is being applied to a fluid moving the tube T. The bellows 28 extend from an intersection 30 with the walls 18 to a round mid portion 32 of the body 12.

Figure 3:
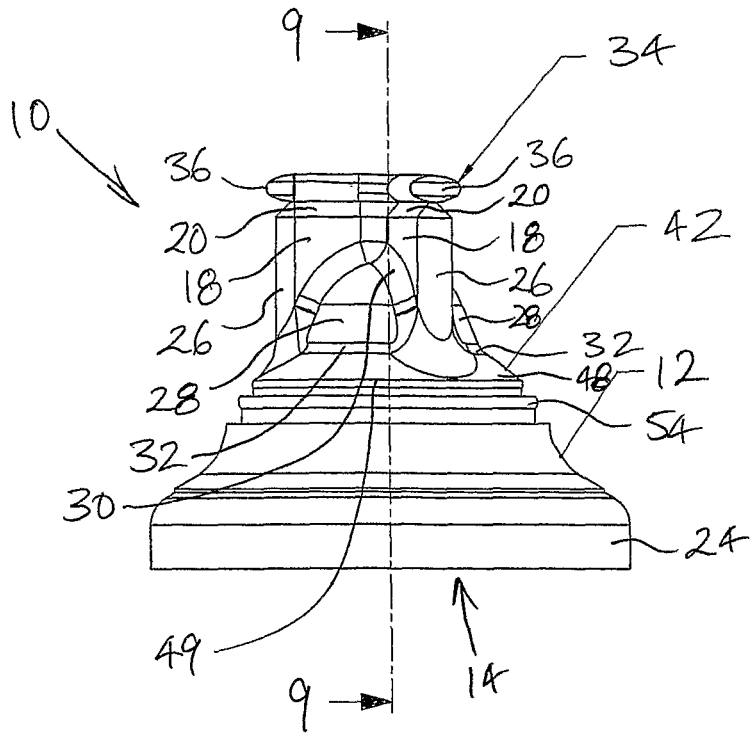
FIGS. 3 and 4 illustrate side and plan views of the dispenser illustrated in FIG. 2.
Figure 4:
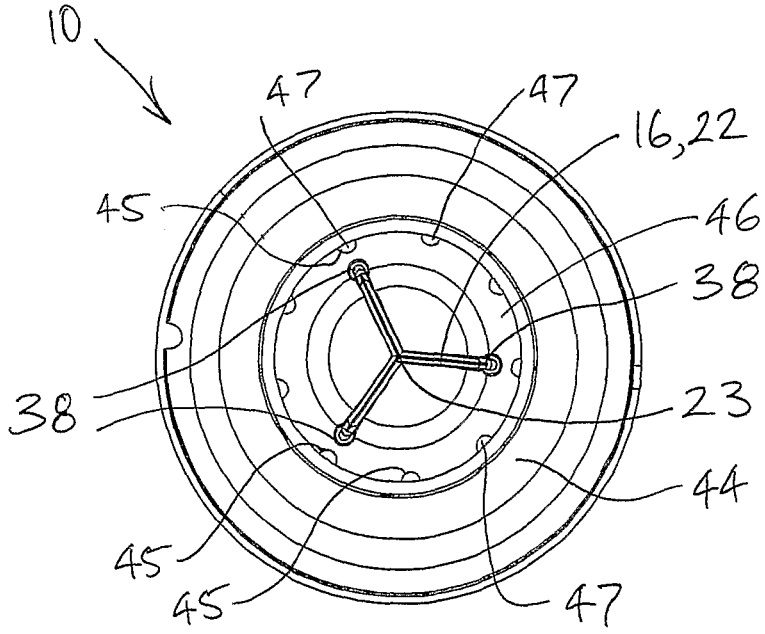

Referring to FIG. 3, a removable seal 34 is positioned over the slits 22. The shape of the seal 34 complements the configuration of the slits 22 to prevent fluid within the tube T being inadvertently extruded therefrom during filling of the tube T and transport between manufacture and tube filling to a user's place of use. As illustrated in FIG. 5, the seal 34 is frangibly connected to the first body 24 near its ends 36, through the distal ends 38 of the slits 22. In use, the user will remove the seal 34 from the first body 24 using manual force to break the frangible connections between the seal 34 and the first body 24 and discard the seal 34. The seal can also act as a tamper evident mechanism whereby if any one of the three frangible connections between the seal 34 and the valve body 12 are broken prior to the user removing the seal 34, the user will be aware that the tube may have been tampered with prior to purchasing.

Figure 9:
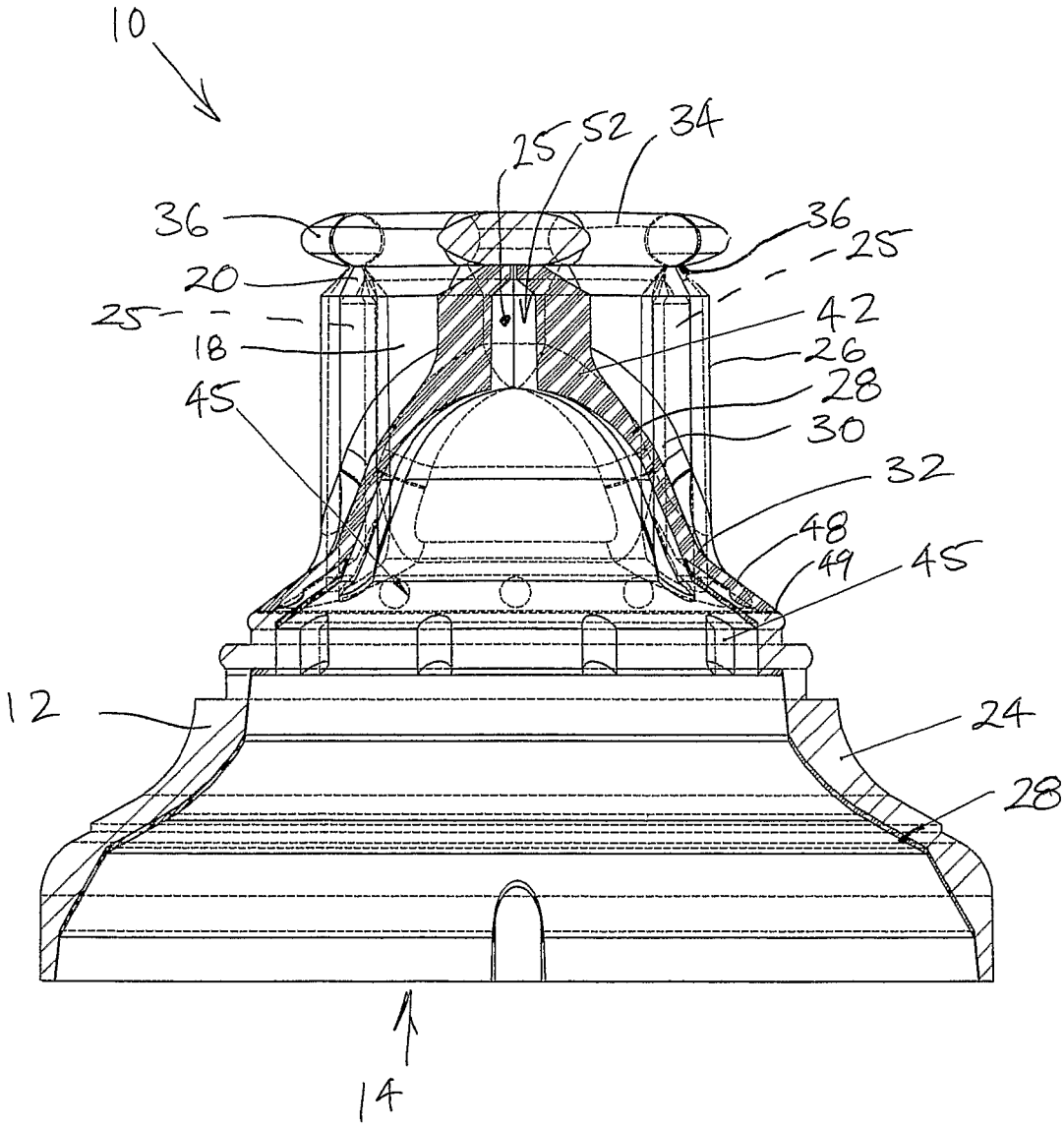
FIG. 9 illustrates a cross-sectional side elevation of the dispenser taken on line 9-9 in FIG. 3.

In this embodiment, the valve component 10 is moulded using a co-injection/bi-material moulding process. Referring in particular to FIG. 5, the first body 24 is formed from high density polyethylene (HDPE) by injection moulding using known methods. The first body 24 comprises the inlet 14, the round mid portion 32, the support posts 25 and the removable seal 34. Once set, the first body 24 is placed into a second mould and a second body 42 (see FIG. 8) is formed thereover from silicon, such as liquid silicon or thermoplastic silicon. The second body 42 comprises the walls 18, slits 22 and bellows 28. The second body 42 is formed over the support posts 25 and the entire inner surface 44 of the first body 24 such that none of the first body 24 is exposed to the fluid within the tube T. Silicon has been chosen in this embodiment for its flexible properties as well as its low flavour scalping properties. As is known, silicon has poor compatibility with other polymers, such as HDPE. This is therefore of issue in the manufacture of the valve component 10. Therefore, the first body 24 comprises holes 45 in a shoulder portion 46 through which respective plugs 47 of silicon of the second body 42 are moulded to lock the second body 42 to the first body 24. A flap 48 overlaps the shoulder portion 46 for continuity with the plugs 47. As illustrated in FIG. 9, a distal end 49 of the flap 48 is moulded into an undercut 50 of the first body 24 to aid in locking the flap 48 in the first body 24 to prevent the flap 48 from peeling or flapping up with respect to the first body. Also, as illustrated in FIGS. 5 and 9, each support post 25 comprises a longitudinal, axially directed recess 52. Each recess 52 is present to receive a respective moulding pin to support the posts 25 during moulding of the second body 42 thereover.

During the moulding of the second body 42, the walls 18 are moulded up to the seal 34, and the seal 34 is compressed laterally to form a recess on its surface opposing the slits 22. This recess is formed to accommodate the levelled edge of the walls 18 to prevent undesired opening of the slits 22, the slits 22 being retained within the seal's 34 recess.

Figure 6:
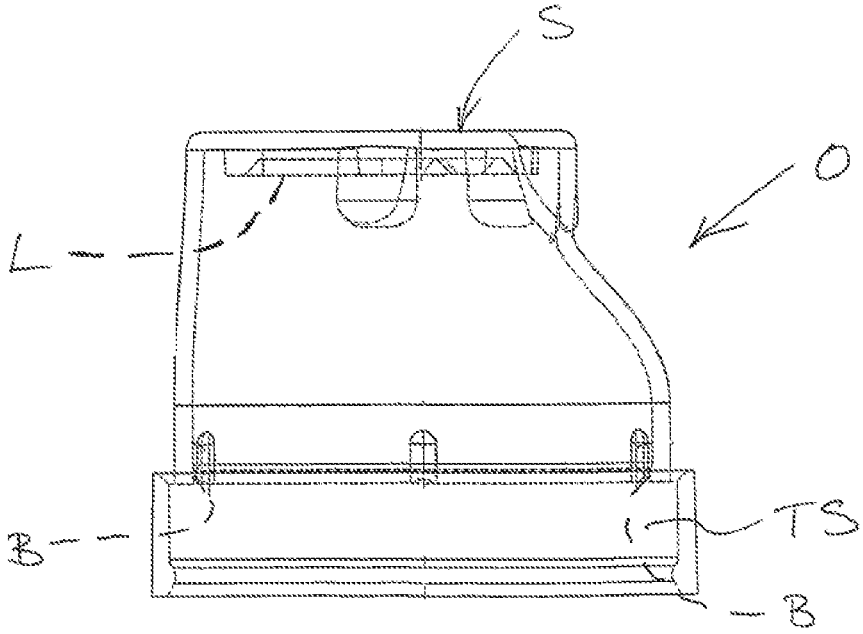
FIG. 6 illustrates a side view of a cap for use with the dispenser.
Figure 7:
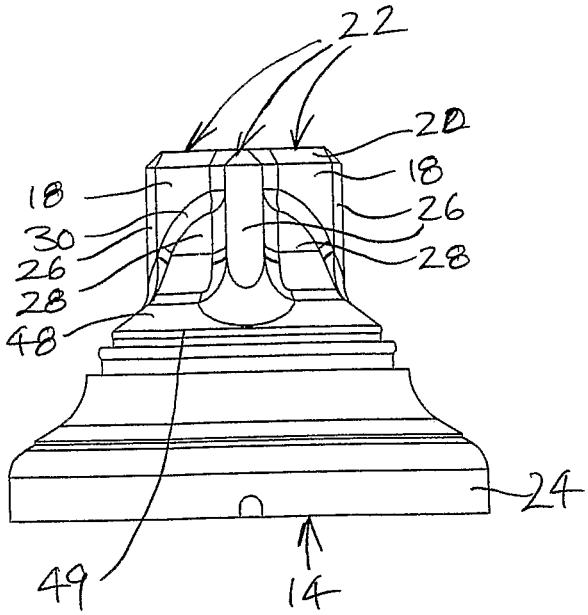
FIG. 7 illustrates a side view of the dispenser illustrated in FIG. 3 where the seal is detached therefrom.
Figure 8:
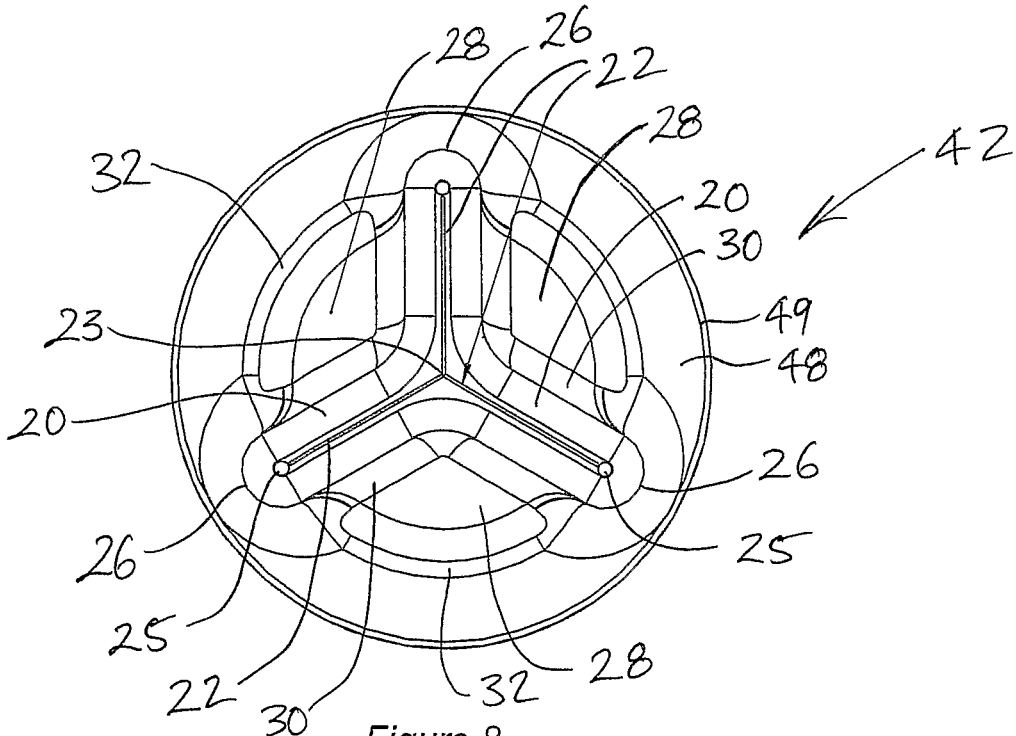
FIG. 8 illustrates a plan view of the dispenser illustrated in FIG. 3.

The overcap O, illustrated in FIG. 6, is formed separately to the valve component 10 from a low cost material, in this embodiment HDPE, prior to assembly on the valve component 10. The overcap O serves several functions. It can be used to prevent fluid dispensing from the valve component 10 after removal of the removable seal 34, it can protect the valve component 10 during transport, handling and filling of the tube T, and it protects the valve component, in particular the silicon second body 42 during welding of the valve component 10 at its inlet 14 to the tube T, which may subject the valve component 10 to temperatures of about 400° C. Furthermore, since the overcap O encapsulates the removable seal 34 during transport, etc, it prevents accidental seal removal and waste, capturing the seal 34 in the overcap O. In the embodiment of the overcap O illustrated in FIG. 6, its shape approximates the shape of the valve component 10. As will be understood, alternative embodiments of the overcap may closer approximate a cylindrical shape, triangular prismic shape, or other such shape as may be desired.

The overcap O comprises a tamper evident tear strip TS. When present, the tear strip TS adds to the overall axial length of the overcap O, which in effect allows room within the overcap to house the valve component 10 and seal 34 therein. When the tube T is to be used for the first time, the user will remove or at least damage the tear strip TS from/on the overcap O, enabling removal of the overcap O from the valve component 10. If not already removed, the user can then remove and discard the tear strip TS prior to removing and discarding the seal 34. Referring to FIGS. 3 and 6, the first body 24 comprises a bead 54 for overcentred releasable interlockability with a corresponding bead B on an inner surface of the overcap O, when the tear strip TS is removed. This can be achieved given that removal of the tear strip TS reduces the axial length of the overcap O by about the same amount as the axial length of the valve component is reduced once the seal 34 is removed. The overcap O comprises lugs L on an internal surface, opposite the distal surface S, which interact with the outlet 16 to prevent the valve component 10 from opening when the overcap O is thereon. In an alternative embodiment, the tear strip TS is formed of frangibly connected elements whose frangible connections are broken when the overcap O is removed from the valve component 10, yet remain connected to the overcap O.

As will be understood, silicon tends not to adhere or mix with different polymers such as HDPE. Therefore, the HDPE component comprises a bead over which a proximal end of the elastomeric component is positioned to aid in fixing the elastomeric component to the rigid component. Furthermore, the silicon component is moulded over the posts, as mentioned previously, which further aids to retain the elastomeric component on the rigid component.

As will be understood, various features of the valve component described above may take different forms in alternative arrangements. For example, the supports may be in the form of walls within the elastomeric walls, or outer supports on an outside surface of the elastomeric second body 42. Furthermore, the valve component may comprise four or more walls and slits associated therewith, or two walls and slits associated therewith. In either case (two or four or more walls), the walls are on intersecting planes. In a further alternative arrangement, the walls may not be planar, but curved, such that they are either convex on one side and concave on an opposite side, or convex on one side and convex on an opposite side.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the dispenser.

While the dispenser has been described in reference to its specific embodiments, it is to be understood that the words which have been used are words of description rather than limitation and that changes may be made to the dispenser without departing from its scope as defined herein.

The invention claimed is:

1. A dispenser and container combination for dispensing a fluid;

the container arranged for containing the fluid, the container comprising a portion that is able to be displaced to apply pressure to the fluid contained in the container;

the dispenser comprising:

a first resilient part having an inlet for connecting to the container so as to receive from the container the fluid under pressure therethrough; and, a second elastomeric part having an outlet comprising at least two upstanding walls extending from the first resilient part, each wall having a respective slit on a distal end thereof adapted to open to release fluid therefrom once a predetermined pressure has been applied to the fluid in the dispenser at the outlet, and to close to retain fluid in the dispenser at a pressure less than the predetermined pressure, wherein the walls intersect as a point and the respective slit on each respective wall distal end extends from the point at which the walls intersect towards a lateral end of each respective wall such that the slits are co-joined at a respective proximal end thereof; and, at least one resilient support post located in the lateral end of, and covered by, each respective wall;

wherein the second elastomeric part comprises at least one respective support region between and integral with at least one pair of walls positioned away from the slits and arranged so as to bias the slits towards a closed condition when no pressure is applied to the fluid, wherein the support posts are formed with the first resilient part and the second elastomeric part is molded onto the first resilient part, and wherein at least one support region comprises a bellows.

2. The dispenser of claim 1, wherein a respective lateral face of each of two adjacent said walls are on intersecting planes and the slits are each located on an end of at least one of the respective said walls.

3. The dispenser of claim 1, wherein the support posts comprise high density polyethylene.

4. The dispenser of claim 1, comprising three said support posts and three said walls, wherein each of the support posts is associated with a respective one of the walls.

5. The dispenser of claim 1, wherein each support region extends out from a plane of a respective face of its respective wall.

6. The dispenser of claim 1, wherein each support region is rounded.

7. The dispenser of claim 1, wherein the inlet is round.

8. The dispenser of claim 1, comprising a removable seal over the slits.

9. The dispenser of claim 8, comprising a removable seal over the slits, wherein the seal is frangibly connected to distal ends of the support posts.

10. The dispenser of claim 1, wherein the slits are equiangular to each other.

11. The dispenser of claim 1, wherein the walls and support regions comprise silicon.

12. The dispenser of claim 1, wherein the walls are parallel to a central dispenser axis that extends from the outlet to the inlet, said slits extending radially from the axis.

13. The dispenser of claim 1, comprising three said walls being equi-angularly spaced about a common axis.

14. A dispenser for dispensing a fluid from a container, the dispenser comprising:

a first resilient part having an inlet for connecting to the container so as to receive the fluid therethrough; and, a second elastomeric part having an outlet comprising at least two upstanding walls extending from the first resilient part, each wall having a respective slit on a distal end thereof adapted to open to release fluid therefrom when a predetermined pressure is applied to the fluid in the dispenser at the outlet and to close to retain fluid in the dispenser at a pressure less than the predetermined pressure, wherein the walls intersect as a point and the respective slit on each respective wall distal end extends from the point at which the walls intersect towards a lateral end of each respective wall such that the slits are co-joined at a respective proximal end thereof; and, at least one resilient support post located in the lateral end of, and covered by, each respective wall;

wherein the second elastomeric part comprises at least one respective support region between and integral with at least one pair of walls positioned away from the slits and arranged so as to bias the slits towards a closed condition when no pressure is applied to the fluid, wherein the support posts are formed with the first resilient part and the second elastomeric part is molded onto the first resilient part, and wherein at least one of the support region comprises a bellows.

15. The dispenser of claim 14 wherein the walls are planar and at least one of the walls lies on a plane intersecting the plane of at least one other wall.

16. The dispenser of claim 14 wherein the walls are formed from a material which is incompatible with the material from which the support posts are formed.

17. The dispenser of claim 14 wherein the first resilient part is formed from a polymer selected from a group comprising: a nylon (polyamide); a polyethylene such as high density polyethylene (HDPE); a polypropylene; a polyethylene terephthalate; a polybutylene terephthalate.

18. The dispenser of claim 14 wherein the second elastomeric part is formed from a polymer selected from a group comprising: silicon; a thermoplastic or thermoset elastomer-rubber; another relatively flexible/deformable elastomer; thermoplastic polyurethane (TPU).

* * * * *